United States Patent [19]

Harrington

[11] 4,212,833

[45] Jul. 15, 1980

[54] CARBURETOR

[75] Inventor: David L. Harrington, Troy, Mich.

[73] Assignee: General Motors Corporation, Detroit, Mich.

[21] Appl. No.: 681,786

[22] Filed: Apr. 30, 1976

[51] Int. Cl.[2] ..... F02M 19/06

[52] U.S. Cl. ..... 261/23 A; 261/67; 261/39 A

[58] Field of Search ..... 261/23 A, 39 A, 67, 261/69 R

[56] References Cited

U.S. PATENT DOCUMENTS

| | | | |
|---|---|---|---|
| 1,620,827 | 3/1927 | Mock et al. | 261/23 A |
| 2,020,778 | 11/1935 | Gregg | 261/39 A |
| 3,342,462 | 9/1967 | Mick | 261/67 |
| 3,343,820 | 9/1967 | Elliott | 261/23 A |
| 3,800,766 | 4/1974 | Schubeck | 261/67 |
| 3,983,189 | 9/1976 | Taylor | 261/67 |

*Primary Examiner*—Tim R. Miles
*Assistant Examiner*—Gregory N. Clements
*Attorney, Agent, or Firm*—C. K. Veenstra

[57] ABSTRACT

In a two-barrel carburetor, a pair of plain tube mixture conduits each has a main well receiving fuel through a flow restriction which opens upwardly from the high point of a metered fuel plenum. The plenum receives fuel through a main jet controlled by a metering rod which is positioned by a vacuum responsive piston, through an auxiliary jet controlled by a metering rod which is positioned by an ambient pressure responsive bellows, and if desired through another auxiliary jet controlled by a manually adjustable metering rod.

2 Claims, 3 Drawing Figures

CARBURETOR

This invention relates to a carburetor having an improved main metering system.

In one prior art carburetor, each of a pair of plain tube primary mixture conduits has a main well supplied with fuel by an individual main metering orifice and by one or more common auxiliary metering orifices. The auxiliary metering orifices open into an auxiliary fuel passage that splits into a pair of transfer passages which lead to the main wells. Substantial care must be taken in producing such a carburetor to assure that the fuel flow parameters do not cause unequal division of fuel between the main wells.

This invention provides a carburetor in which fuel metered by such a plurality of orifices is not subjected to flow conditions apt to cause unequal division of fuel between the main wells. In the carburetor provided by this invention, the fuel metered by one main and one or more auxiliary orifices is received in a common metered fuel plenum and is then divided by and delivered through a pair of flow restrictions to the main wells. This construction thus assures equal fuel delivery to the main wells.

The carburetor provided by this invention also provides certain other advantages over the prior art carburetor. For example, fuel delivery from the auxiliary metering orifices of the prior art carburetor occasionally was disturbed by vapor bubbles generated in the auxiliary fuel passage. In this carburetor, on the other hand, the flow restrictions open into the main wells from the highest region of the metered fuel plenum and thus assure rapid purging of any vapor bubbles which may be generated.

The details as well as other features and advantages of this invention are set forth in the remainder of the specification and are shown in the drawings in which.

Figure 1:
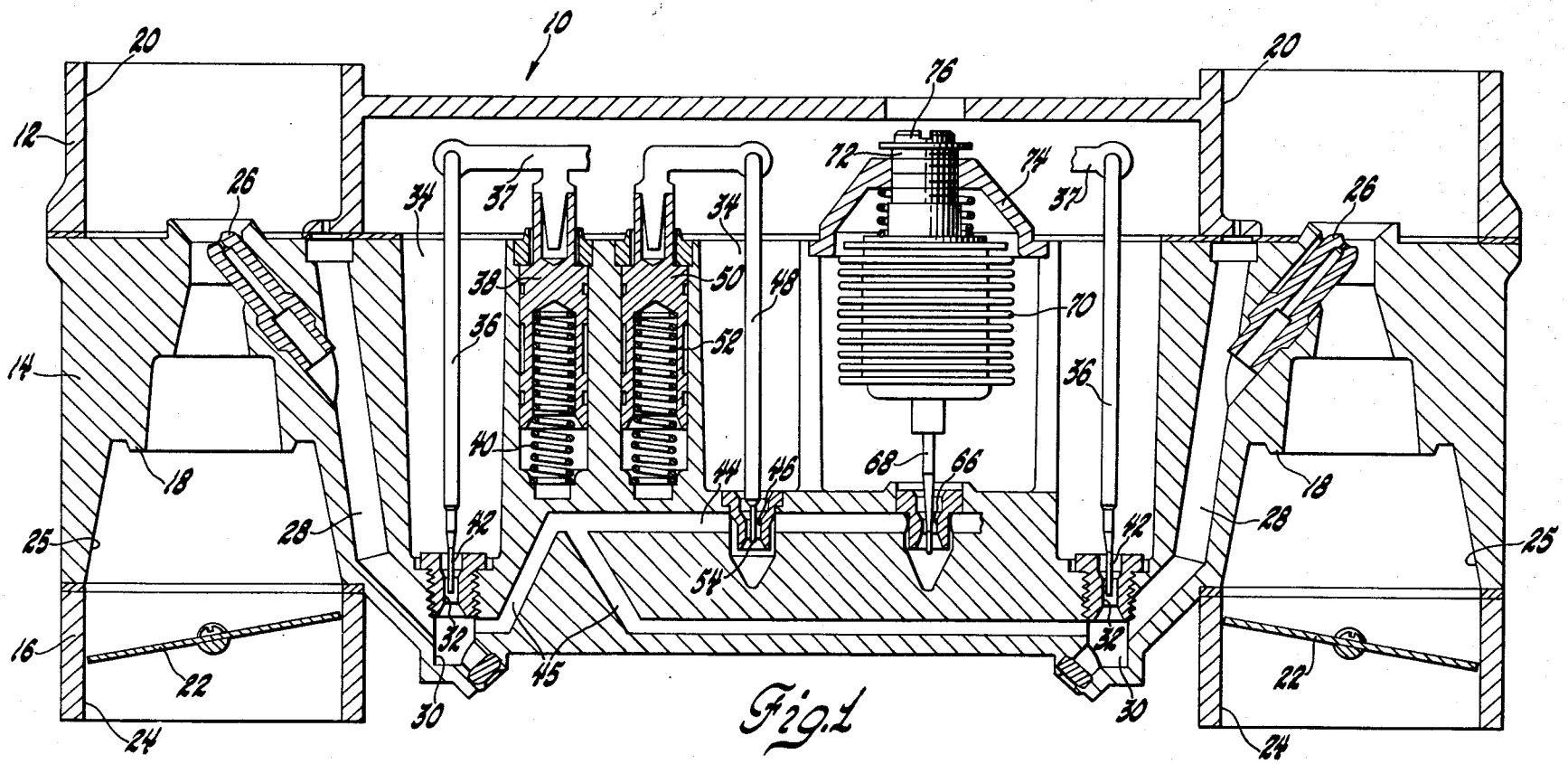
FIG. 1 is a schematic view of the aforementioned prior art carburetor, in sectional elevation, showing the components of its primary main metering system.

Referring first to FIG. 1, prior art carburetor 10 has an air horn section 12, a fuel bowl section 14, and a throttle body section 16. Fuel bowl section 14 has a pair of venturi clusters 18 which receive air through air inlets 20 in air horn section 12 and which discharge an air-fuel mixture past throttles 22 disposed in outlets 24 in throttle body section 16. Air inlets 20, venturi clusters 18, and outlets 24 define a pair of plain tube carburetor mixture conduits 25.

A pair of nozzles 26 discharge fuel from a pair of main wells 28 into venturi clusters 18 for mixture with the air flow therethrough. Each main well 28 has a lower portion 30 which receives fuel through a main metering orifice or jet 32 from a fuel bowl 34. A pair of main metering rods 36 depend from a common hanger 37 which is positioned by a main vacuum piston 38 and, when lowered against the bias of a spring 40, restricts fuel flow through main jets 32. When spring 40 lifts piston 38, reduced portions 42 on metering rods 36 permit increased fuel flow through main jets 32.

An auxiliary fuel passage 44 opens through a pair of transfer passages 45 into the lower portions 30 of main wells 28. An auxiliary metering orifice or jet 46 opens into auxiliary passage 44 from fuel bowl 34. Auxiliary jet 46 is controlled by an auxiliary metering rod 48 which is positioned by an auxiliary vacuum piston 50. When vacuum piston 50 is lowered against the bias of a spring 52, auxiliary rod 48 restricts fuel flow through auxiliary jet 46. When auxiliary piston 50 and auxiliary rod 48 are lifted by spring 52, a reduced portion 54 on rod 48 permits increased fuel flow through auxiliary jet 46.

A second auxiliary metering orifice or jet 66 also opens from fuel bowl 34 into auxiliary passage 44. A tapered metering rod 68 controls flow through jet 66. Metering rod 68 is secured to a bellows 70 which is responsive to the pressure in fuel bowl 34 under air horn 12 and thus is responsive to the ambient atmospheric pressure. As the ambient pressure increases, bellows 70 is compressed to lift metering rod 68 and permit an increased flow of fuel through jet 66; as the ambient pressure decreases, bellows 70 expands to lower rod 68 in jet 66 and restrict the flow of fuel therethrough. Bellows 70 thereby causes rod 68 to vary the fuel flow to venturi clusters 18 in accordance with variations in atmospheric pressure and thus prevents variations in the air-fuel ratio which would otherwise occur due to changes in the air mass flow through mixture conduits 25 with variations in atmospheric pressure.

Bellows 70 has a stem 72 which is threaded through a bellows cover and supporting member 74 secured in fuel bowl section 14. Stem 72 has a slotted head 76 by which stem 72, belows 70 and rod 68 may be rotated to adjust the position of rod 68 in jet 66. That construction permits adjustment of the part throttle air-fuel ratio provided by carburetor 10.

Figure 2:
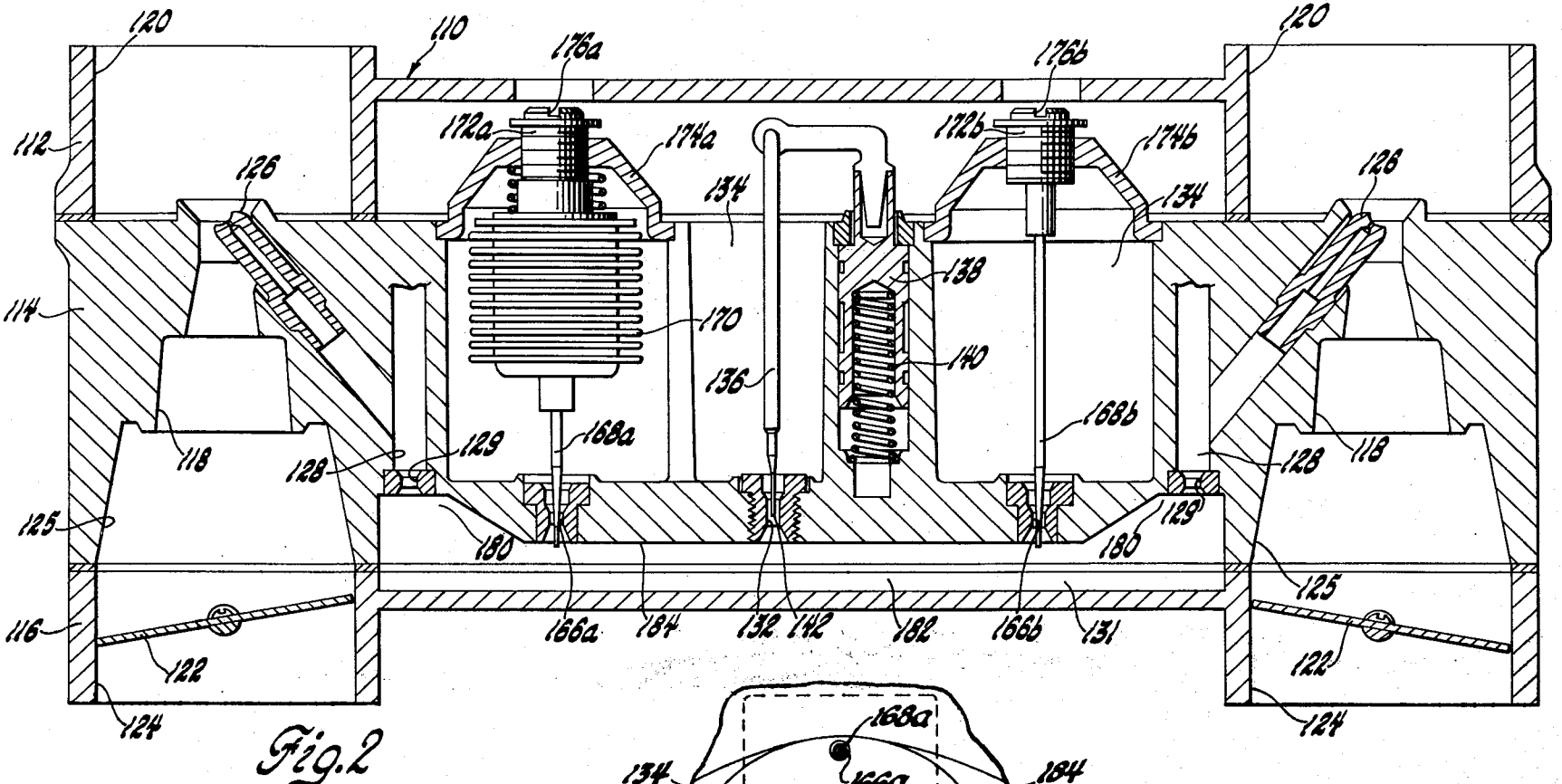
FIG. 2 is a similar view of a carburetor containing a preferred embodiment of this new main metering system.
Figure 3:
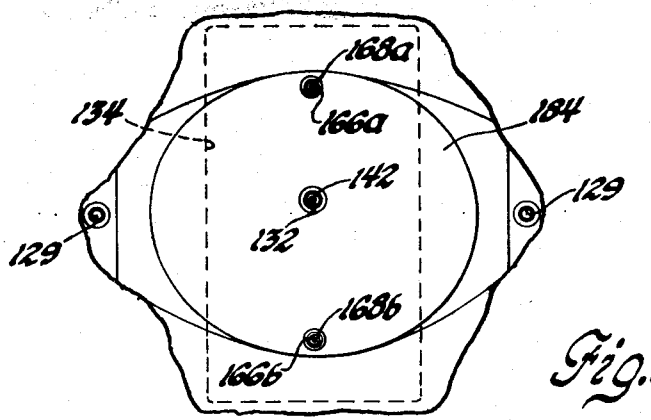
FIG. 3 is a bottom plan view of a preferred layout for the metered fuel plenum.

Referring now to FIGS. 2 and 3, the carburetor 110 provided by this invention has an air horn section 112, a fuel bowl section 114, and a throttle body section 116. Fuel bowl section 114 has a pair of venturi clusters 118 which receive air through air inlets 120 in air horn section 112 and which discharge an air-fuel mixture past throttles 122 disposed in outlets 124 in throttle body section 116. Air inlets 120, venturi clusters 118, and outlets 124 define a pair of plain tube carburetor mixture conduits 125.

A pair of nozzles 126 discharge fuel from a pair of main wells 128 into venturi clusters 118 for mixture with the air flow therethrough. Each main well 128 receives fuel through a flow restriction 129 from a metered fuel plenum 131.

A main metering orifice or jet 132 opens from a fuel bowl 134 into metered fuel plenum 131. A main metering rod 136 is positioned by a main vacuum piston 138 and, when lowered against the bias of a spring 140, restricts fuel flow through main jet 132. When spring 140 lifts piston 138, a reduced portion 142 on metering rod 136 permits increased fuel flow through main jet 132.

A pair of auxiliary metering orifices or jets 166*a* and 166*b* also open from fuel bowl 134 into metered fuel plenum 131. A pair of tapered auxiliary metering rods 168*a* and 168*b*, control flow through jets 166*a* and 166*b* respectively. Metering rod 168*a* is secured to a bellows 170 which is responsive to the pressure in fuel bowl 134 under air horn 112 and thus is responsive to the ambient atmospheric pressure. As the ambient pressure increases, bellows 170 is compressed to lift metering rod 168*a* and permit an increased flow of fuel through jet 166*a*; as the ambient pressure decreases, bellows 170 expands to lower rod 168*a* in jet 166*a* and restrict the flow of fuel therethrough. Bellows 170 thereby causes rod 168*a* to vary the fuel flow to venturi clusters 118 in accordance with variations in atmospheric pressure and thus prevent variations in the air-fuel ratio which would otherwise occur due to changes in the air mass flow through mixture conduits 125 with variations in atmospheric pressure.

Bellows 170 has a stem 172*a* which is threaded through a bellows cover and supporting member 174*a* secured in fuel bowl section 114. Stem 172*a* has a slotted head 176*a* by which stem 172*a*, bellows 170 and rod 168*a* may be rotated to adjust the position of rod 168*a* in jet 166*a*. This construction permits calibration of the altitude compensating feature provided by bellows 170 and rod 168*a*.

Metering rod 168*b* is secured directly to a stem 172*b* which is threaded through a supporting member 174*b* secured in fuel bowl section 114. Stem 172*b* has a slotted head 176*b* by which stem 172*b* and rod 168*b* may be rotated to adjust the position of rod 168*b* in jet 166*b*. This construction permits manual adjustment of the part throttle air-fuel ratio provided by carburetor 110. It will be appreciated, of course, that use of more than one auxiliary jet and auxiliary metering rod is optional. It also will be appreciated that other positioning mechanisms may control the main and auxiliary metering rods without departing from this invention.

As shown in FIG. 3, metering jets 132, 166*a* and 166*b* preferably are disposed equidistantly from the flow restrictions 129 which open into main wells 128.

This construction, having a pressure equalizing metered fuel plenum 131, allows fuel for both mixture conduits 125 to be initially metered in a unified flow through jets 132, 166*a* and 166*b* into plenum 131 and then to be divided by flow restrictions 129 for delivery through main wells 128 and nozzles 126 into mixture conduits 125 and thus assures that each mixture conduit 125 will receive the fuel required by the signal generated in its venturi cluster 118.

As may be noted from FIG. 2, flow restrictions 129 open upwardly to main wells 128 from the highest region 180 of metered fuel plenum 131, jets 132, 166*a* and 166*b* open from fuel bowl 134 into the lowest region 182 of plenum 131, and the roof 184 of plenum 131 slopes continuously upwardly from region 182 to region 180. This construction assures that any vapor bubbles generated as fuel flows through the jets will be readily purged through the flow restrictions.

The embodiments of the invention in which an exclusive property or privilege is claimed are defined as follows:

1. An internal combustion engine carburetor comprising first and second mixture conduits through which air may flow to the engine, first and second discharge nozzles respectively opening into said mixture conduits for delivering fuel into and mixing such fuel with the air flow through said mixture conduits, first and second main wells respectively extending to said discharge nozzles for supplying fuel thereto, a fuel bowl, a plurality of independently controllable metering orifices opening from said fuel bowl for delivering fuel therefrom at a controlled rate, a metered fuel plenum for receiving fuel delivered by said metering orifices, and first and second flow restrictions respectively opening upwardly from the highest region of said metered fuel plenum to said main wells for dividing fuel received by said plenum for delivery to said first and second main wells, whereby fuel may be initially metered in a unified flow and subsequently divided for delivery to said first and second mixture conduits.

2. An internal combustion engine carburetor comprising first and second mixture conduits through which air may flow to the engine, first and second discharge nozzles respectively opening into said mixture conduits for delivering fuel into and mixing such fuel with the air flow through said mixture conduits, first and second main wells respectively extending to said discharge nozzles for supplying fuel thereto, a fuel bowl, a plurality of independently controllable metering orifices opening from said fuel bowl for delivering fuel therefrom at a controlled rate, a metered fuel plenum for receiving fuel delivered by said metering orifices, and first and second flow restrictions respectively opening upwardly from the highest region of said metered fuel plenum to said main wells for dividing fuel received by said plenum for delivery to said first and second main wells, said metering orifices, metered fuel plenum and flow restrictions providing the sole path for fuel flow from said fuel bowl to said main wells whereby fuel may be initially metered in a unified flow and subsequently divided for delivery to said first and second mixture conduits.

* * * * *